US007902808B2

(12) United States Patent
Hashimoto

(10) Patent No.: US 7,902,808 B2
(45) Date of Patent: Mar. 8, 2011

(54) CONSTANT CURRENT CIRCUIT FOR SUPPLYING A CONSTANT CURRENT TO OPERATING CIRCUITS

(75) Inventor: Fuminori Hashimoto, Fukaya (JP)

(73) Assignees: Sanyo Electric Co., Ltd., Osaka (JP); Sanyo Semiconductor Co., Ltd., Gunma (JP)

( * ) Notice: Subject to any disclaimer, the term of this patent is extended or adjusted under 35 U.S.C. 154(b) by 304 days.

(21) Appl. No.: 11/963,412

(22) Filed: Dec. 21, 2007

(65) Prior Publication Data

US 2008/0174294 A1 Jul. 24, 2008

(30) Foreign Application Priority Data

Dec. 27, 2006 (JP) ..... 2006-351118

(51) Int. Cl.
*G05F 3/16* (2006.01)
*G05F 3/20* (2006.01)

(52) U.S. Cl. ..... 323/313; 323/314; 323/315; 327/539; 327/540

(58) Field of Classification Search ..... 323/313, 323/314, 315; 327/539, 540
See application file for complete search history.

(56) References Cited

U.S. PATENT DOCUMENTS 5,627,490 A * 5/1997 Sushihara et al. ..... 327/510
6,084,391 A * 7/2000 Onodera ..... 323/315
6,150,885 A * 11/2000 Ashby et al. ..... 330/257
6,184,742 B1 * 2/2001 Mulder et al. ..... 327/538
6,429,720 B1 * 8/2002 Gilbert ..... 327/348
6,465,997 B2 * 10/2002 Kussener ..... 323/313
6,472,928 B1 * 10/2002 Kadanka ..... 327/538
6,496,057 B2 * 12/2002 Wada et al. ..... 327/543
6,525,601 B2 * 2/2003 Gilbert ..... 327/560
6,545,540 B1 * 4/2003 Enriquez ..... 330/288
6,668,334 B1 * 12/2003 Abel et al. ..... 713/500
6,696,888 B2 * 2/2004 Gilbert ..... 327/560
6,784,652 B1 * 8/2004 Aude ..... 323/316
6,998,902 B2 * 2/2006 Sugimura ..... 327/539
7,132,899 B1 * 11/2006 Gaboury et al. ..... 331/77

(Continued)

FOREIGN PATENT DOCUMENTS

JP 7-121256 5/1995

(Continued)

OTHER PUBLICATIONS esp@cenet patent abstract for Japanese Publication No. 7121256, Publication date May 12, 1995 (1 page).

(Continued)

*Primary Examiner* — Bao Q Vu
(74) *Attorney, Agent, or Firm* — Osha • Liang LLP

(57) ABSTRACT

In order to prevent interference of signals in a plurality of outputs from a current mirror circuit, the current mirror circuit comprises a current mirror input transistor Q1 through which a constant current flows and a plurality of current mirror output transistors Q7 and Q8 which have control ends commonly connected to a control end of the current mirror input transistor Q1. The constant current is supplied from the plurality of current mirror output transistors Q7 and Q8 to a plurality of operating circuits. Further, at least one of the plurality of current mirror output transistors Q7 and Q8 is equipped with a low pass filter for removing a high-frequency component contained in a current output from the at least one of the plurality of current mirror output transistors Q7 and Q8.

5 Claims, 19 Drawing Sheets

U.S. PATENT DOCUMENTS

| | | | | |
|---|---|---|---|---|
| 2002/0079968 | A1* | 6/2002 | Godfrey et al. | 330/258 |
| 2005/0248393 | A1* | 11/2005 | North | 327/551 |
| 2006/0061414 | A1* | 3/2006 | North | 327/551 |

FOREIGN PATENT DOCUMENTS

| | | |
|---|---|---|
| JP | 10-97332 | 4/1998 |
| JP | 2006-33523 | 2/2006 |

OTHER PUBLICATIONS esp@cenet patent abstract for Japanese Publication No. 10097332, Publication date Apr. 14, 1998 (1 page).

esp@cenet patent abstract for Japanese Publication No. 2006033523, Publication date Feb. 2, 2006 (1 page).

* cited by examiner

CONSTANT CURRENT CIRCUIT FOR SUPPLYING A CONSTANT CURRENT TO OPERATING CIRCUITS

CROSS-REFERENCE TO RELATED APPLICATIONS

The disclosure of Japanese Patent Application No. 2006-351118 including specification, claims, drawings and abstract, filed on Dec. 27, 2006 is incorporated herein by reference in its entirety.

BACKGROUND OF THE INVENTION

1. Field of the Invention

The present invention relates to a constant current circuit which includes an input path through which a constant current on an input side of the constant current circuit flows, and an output path through which a constant current on an output side of the constant current circuit corresponding to the constant current on the input side flows.

2. Description of the Related Art

Conventionally, a great number of various current mirror circuits have been used in a semiconductor integrated circuit. Here, some of the current mirror circuits often include, with respect to one current mirror input transistor, a plurality of current mirror output transistors which are connected on a common base to the current mirror input transistor.

Such current mirror circuits are disclosed in Japanese Patent Publications JP 2006-33523, JP H10-97332, JP H07-121256, and other publications.

When a signal is handled using a circuit having a plurality of outputs as described above, in some instances, problems such as interference or leakage of a signal at high frequencies will arise through a base line of a current mirror circuit. In particular, when a gain of a signal to be handled is high, when a MIX circuit is used, or when a signal to be handled is of high frequency, it is highly likely that the above-described problem of signal leakage will occur. Further, there may be cases where the occurrence of the above-described problem causes generation of unexpected oscillation depending on the amount of leakage or phase conditions.

SUMMARY OF THE INVENTION

The present invention provides a constant current circuit comprising a current mirror input, transistor through which a constant current flows, and a plurality of current mirror output transistors. In the constant current circuit, at least one of the plurality of current mirror output transistors is equipped with a low-pass filter for eliminating a high frequency component contained in a current output from the at least one of the plurality of current mirror output transistors.

Accordingly, provision of the low-pass filter can prevent the high frequency component in a circuit connected to an output of one current mirror circuit adversely affecting an output of another current mirror circuit.

BRIEF DESCRIPTION OF THE DRAWINGS

Preferred embodiments of the present invention will be described in detail based on the following figures, wherein.

DESCRIPTION OF THE PREFERRED EMBODIMENTS

Figure 1:
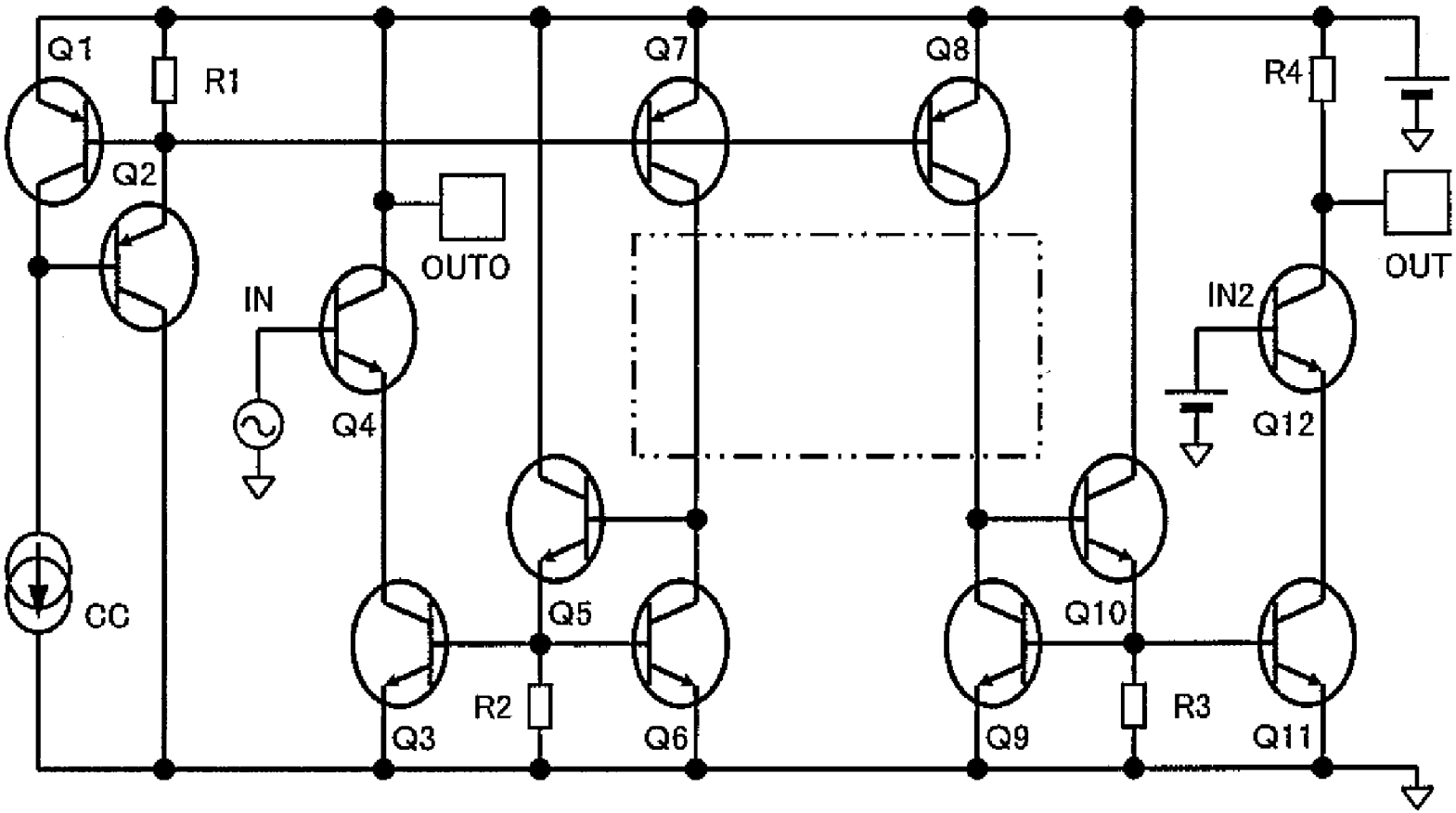
FIG. 1 shows a basic configuration of a constant current circuit according to an embodiment of the present invention.

Referring to the drawings, preferred embodiments of the present invention will be described below.

A mechanism for causing signal leakage will be explained. Here, a high frequency signal region in which a parasitic capacitance in a transistor is not negligible is considered in the description below.

FIG. 1 shows a basic configuration of a constant current circuit according to an embodiment of the present invention. In the constant current circuit, a PNP transistor Q1 has an emitter connected to a positive power supply and a collector connected via a constant current source CC to ground. A base of the transistor Q1 which is a control end of the transistor Q1 is connected to the positive power supply through a resistance R1 and also connected to a collector of a PNP transistor Q2. A base of the transistor Q2 is connected to the collector of the transistor Q1, while a collector of the transistor Q2 is connected to ground. Further, a base line of the transistor Q1 is connected to PNP transistors Q7 and Q8 whose emitters are connected to the positive power supply, and a base current is supplied from the transistor Q2 to the base line. Thus, the transistors Q7 and Q8 constitute a current mirror circuit in conjunction with the transistor Q1.

In addition, an NPN transistor Q4 has a base to which a signal IN is input, a collector connected to the positive power supply, and an emitter connected to a collector of an NPN transistor Q3. An emitter of the transistor Q3 is connected to ground, while a base of the transistor Q3 is connected to ground through a resistance R2 and also connected to both a base of an NPN transistor Q6 and an emitter of an NPN transistor Q5. The transistor Q6 has an emitter connected to ground and a collector connected to a base of the NPN transistor Q5. The transistor Q5 has a collector connected to the positive power supply and an emitter connected to a common base for the transistors Q3 and Q6. Therefore, the transistor Q6 and the transistor Q3 constitute a current mirror. Further, both the collector of the transistor Q6 and the base of the transistor Q5 are connected to a collector of the transistor Q7. As a result, a constant current corresponding to a current that flows through the transistor Q1 is fed from the transistor Q7, and the constant current flows through both the transistor Q6 and the transistor Q3. Therefore, the constant current flows through the transistor Q4 as a bias current, which causes the transistor Q4 to output a current corresponding to the input signal IN from an output terminal OUT0 disposed on a collector side of the transistor Q4.

On the other hand, a collector of the transistor Q8 is connected to a collector of an NPN transistor Q9 whose emitter is connected to ground. A collector of the transistor Q9 is connected to a base of an NPN transistor Q10, and a collector of the transistor Q10 is connected to the positive power supply while an emitter of the transistor Q10 is connected to a base of the transistor Q9.

The base of the transistor Q9 is connected to ground through a resistance R3 and also connected to a base of an NPN transistor Q11. The transistor Q11 has an emitter connected to ground, and constitutes a current mirror in conjunction with the transistor Q9.

A collector of the transistor Q11 is connected to an emitter of an NPN transistor Q12. A collector of the transistor Q12 is connected to the positive power supply through a resistance R4, and a signal IN2 is input to a base of the transistor Q12. In addition, an output terminal OUT is connected to a collector of the transistor Q12.

The constant current that flows through the transistor Q1 is sent to the transistor Q11 and then supplied as the bias current to the transistor Q12. Accordingly, a voltage output in accordance with ah input to the transistor Q12 is obtained at the output terminal OUT.

In the above-described circuit, the transistor Q1 forms the current mirror together with the transistors Q7 and Q8, and the transistors Q7 and Q8 function as a constant current source. In addition, the transistors Q7 and Q8 are circuits for handling different signals.

Here, in order to find leakage of a high-frequency component that leaks to the output terminal OUT in the above-described circuit, the output terminal OUT0 is removed from the circuit, and the input to the base of the transistor Q12 is supplied at a constant voltage. Accordingly, the output terminal OUT0 is removed from the circuits of from FIG. 2 onward, and the input to the base of the transistor Q12 is represented as a direct-current power supply.

Figure 2:
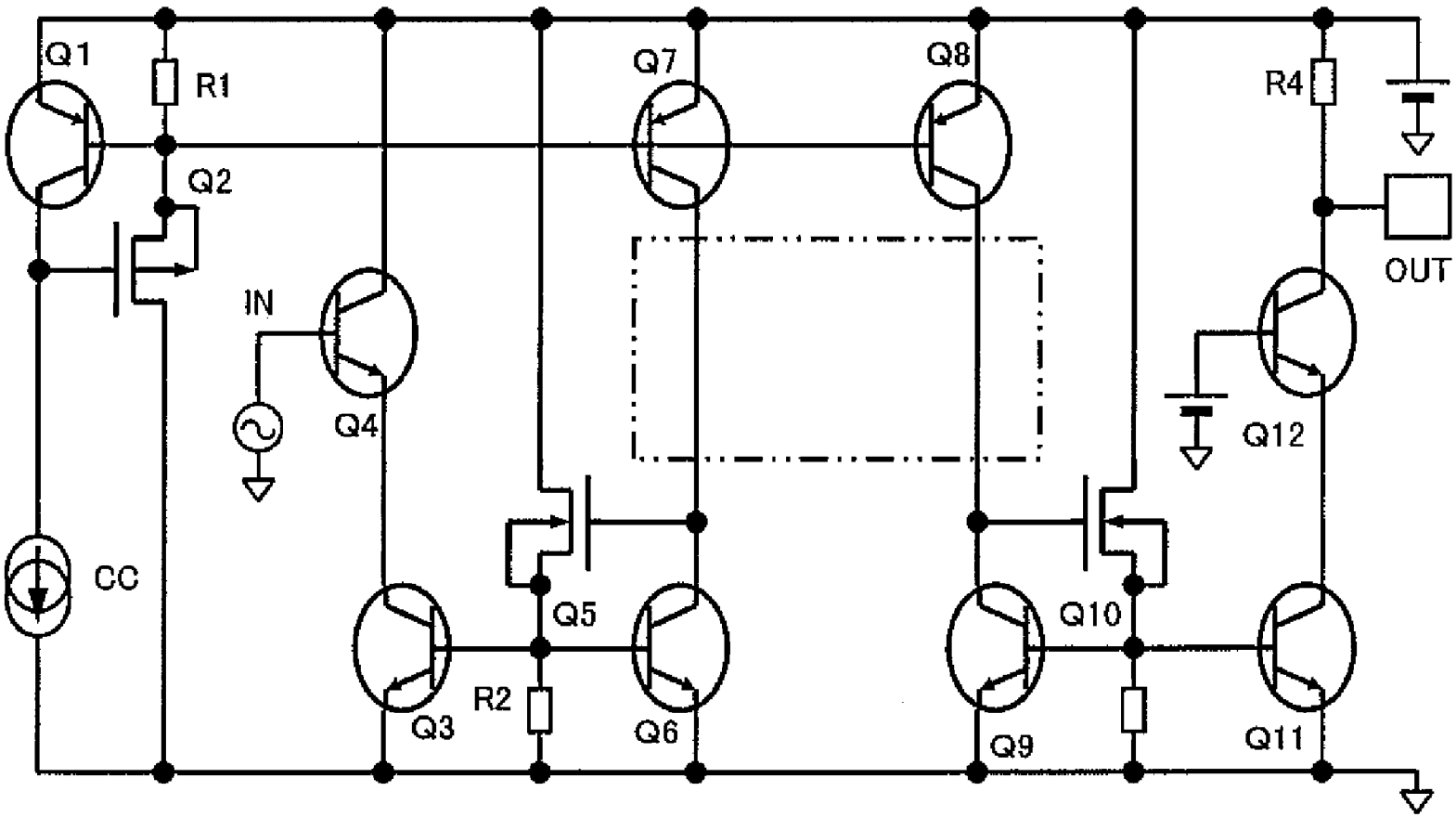
FIG. 2 shows another basic configuration of the constant current circuit.

Then, in FIG. 2, the transistors Q2, Q5, and Q10 disposed between the base and the collector of the transistor Q1 which is located on an input side of the current mirror are composed of MOS transistors. The transistors Q2, Q5, and Q10 function to provide the base current to the transistors that form the current mirror. When the MOS transistors which do not need the base current are used as the transistors Q2, Q5, and Q10, the current mirror can be configured with a high degree of accuracy.

Figure 3:
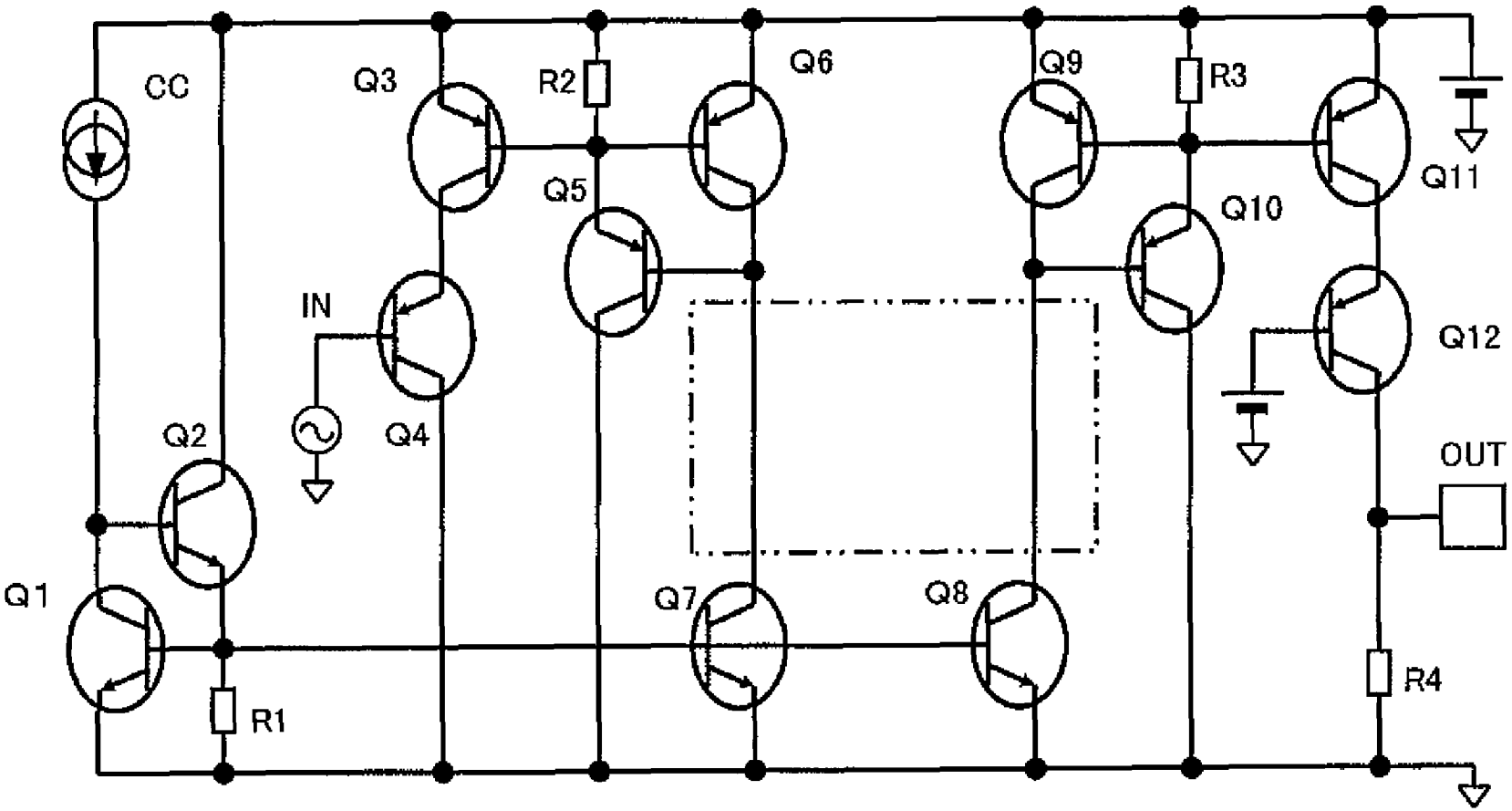
FIG. 3 shows still another basic configuration of the constant current circuit.

In FIG. 3, the transistors Q1, Q2, Q7, and Q8 that constitute the current mirror circuit for supplying the constant current from the constant current source CC shown in FIG. 1 are composed of NPN transistors. Accordingly, the transistors Q3, Q5, Q6, Q9, Q10, and Q11 that constitute another current mirror circuit are composed of PNP transistors. Also in this circuit, the current that flows through the constant current source CC is supplied via the transistors Q7 and Q8 to the transistors Q4 and Q12 as the bias current, and the inputs to the bases of the transistors Q4 and Q12 are respectively obtained at output terminals of the transistors Q4 and Q12.

Figure 4:
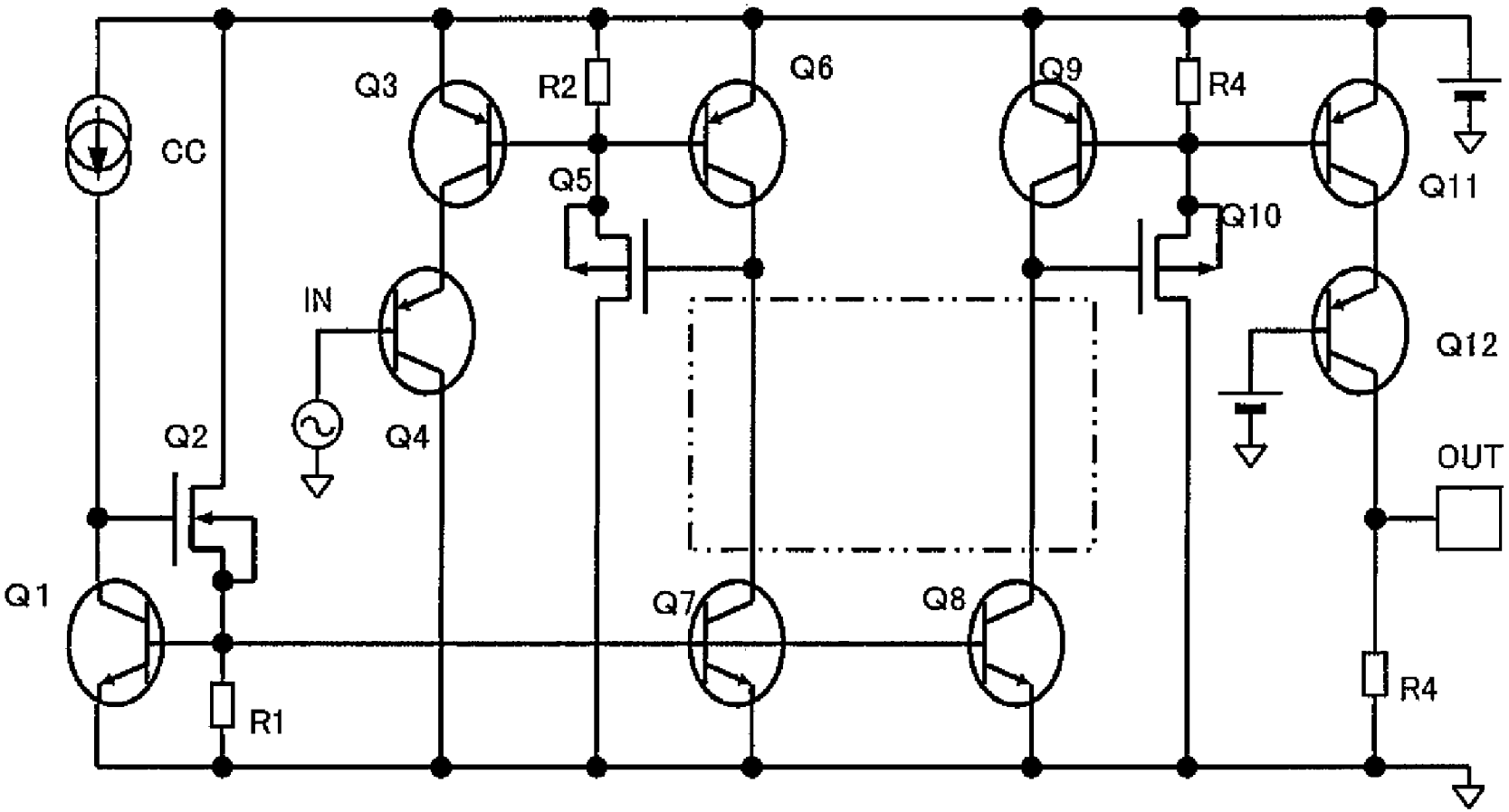
FIG. 4 shows still another basic configuration of the constant current circuit.

FIG. 4 shows an example of using the MOS transistors as the transistors Q2, Q5, and Q10 in the circuit of FIG. 3.

Here, an instance where an input to the transistor Q4 has high frequencies is considered. In the circuit of FIG. 1, because a CB (collector-base) capacitance in each of the transistors is not negligible with respect to a voltage change at the high frequencies, the signal input to the base of the transistor Q4 shown in FIG. 1 is transferred in the following way: the emitter of the transistor Q4=>the CB capacitance of the transistor Q3=>EB of the transistor Q5//the CB capacitance of the transistor Q6=>the CB capacitance of the transistor Q7=>the CB capacitance of the transistor Q8=>the CB capacitance of the transistor Q9//EB of the transistor Q10=>the CB capacitance of the transistor Q11=>the emitter of the transistor Q12 (where the symbol // represents parallel connection). Thus, the input signal acts on the emitter of the transistor Q12, thereby causing the transistor Q12 to operate. As a result of the operation, the input signal leaks from the collector of the transistor Q12 to the output terminal.

Figure 5:
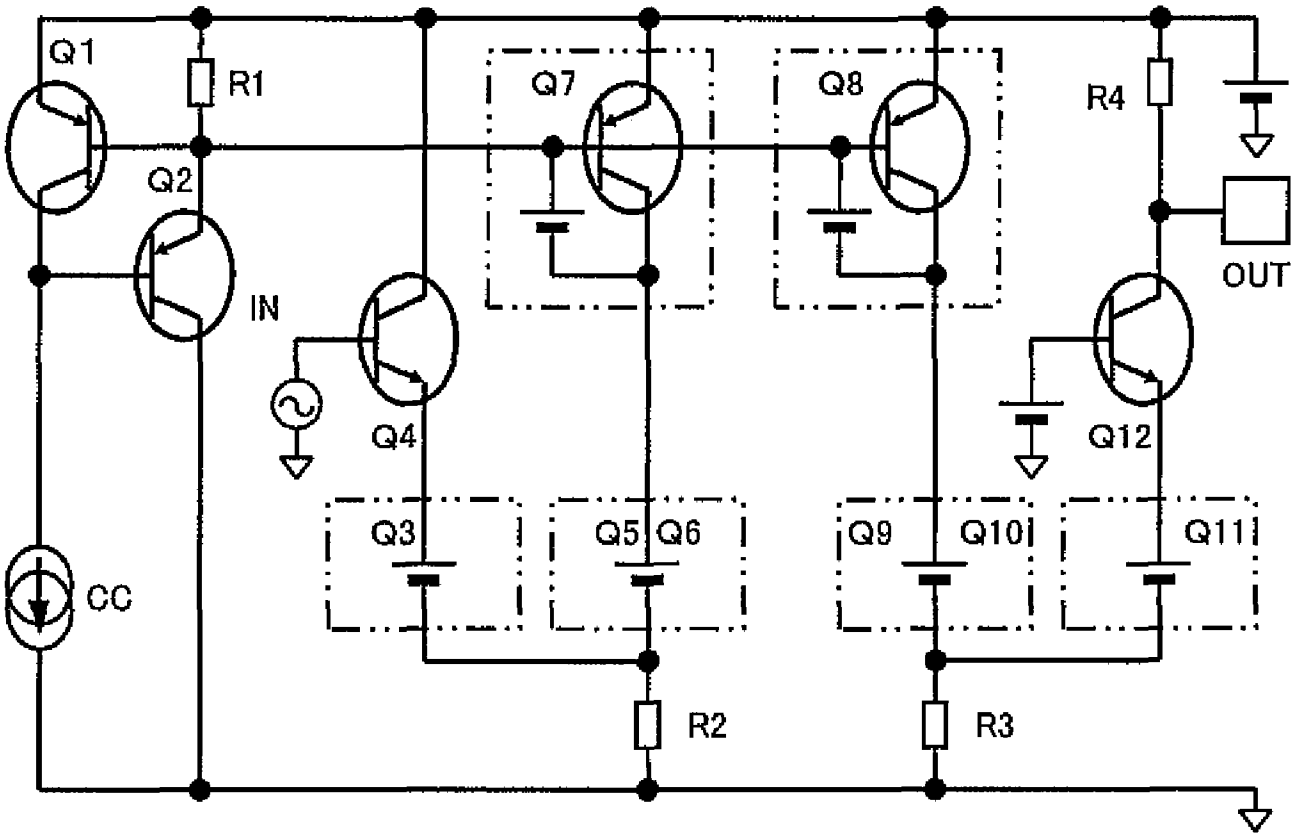
FIG. 5 is a diagram in which the circuit of FIG. 1 is depicted in a simplified form to explain operation of the circuit.
Figure 6:
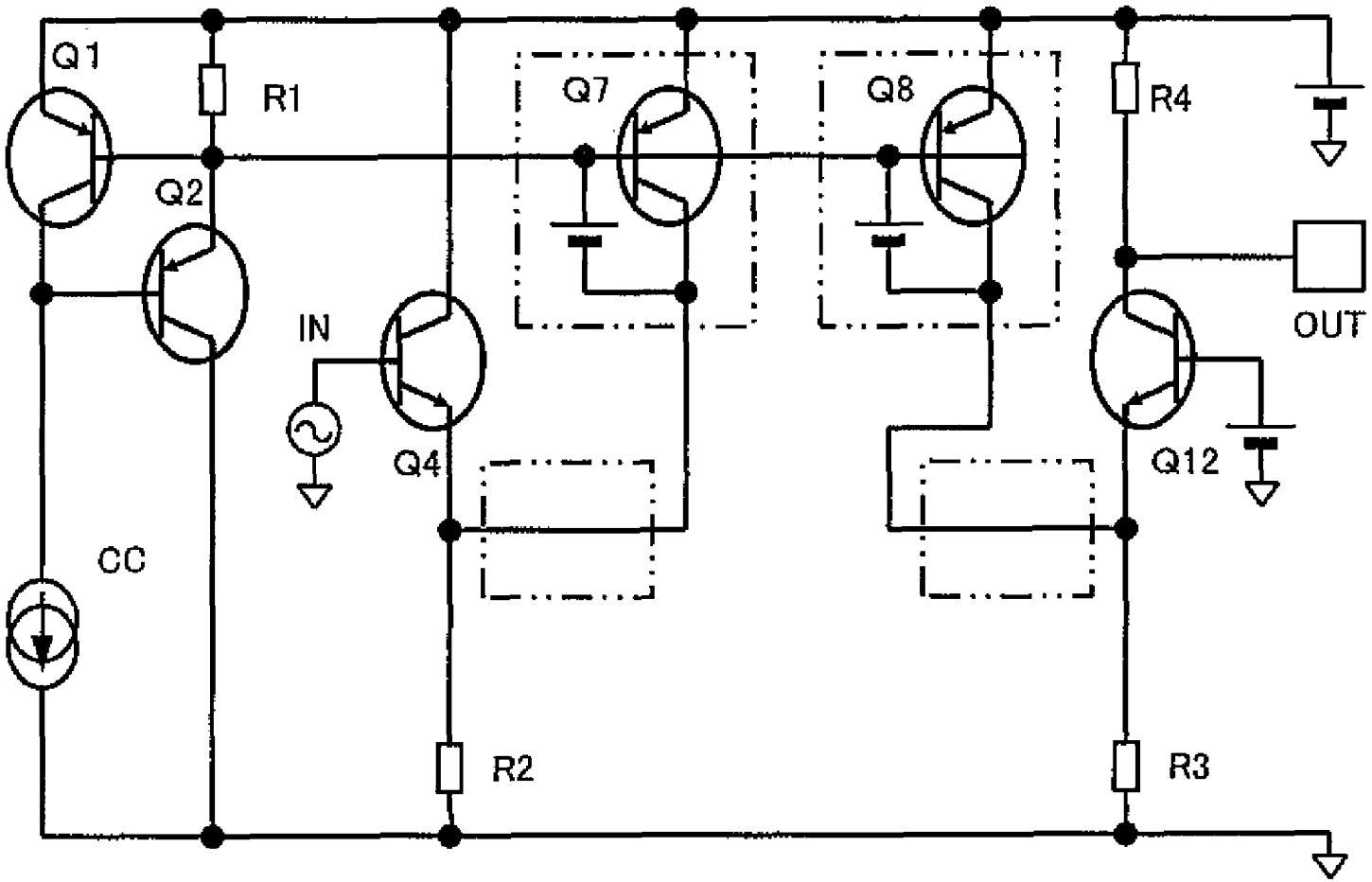
FIG. 6 depicts a further simplified form of the circuit shown in FIG. 5.
Figure 7:
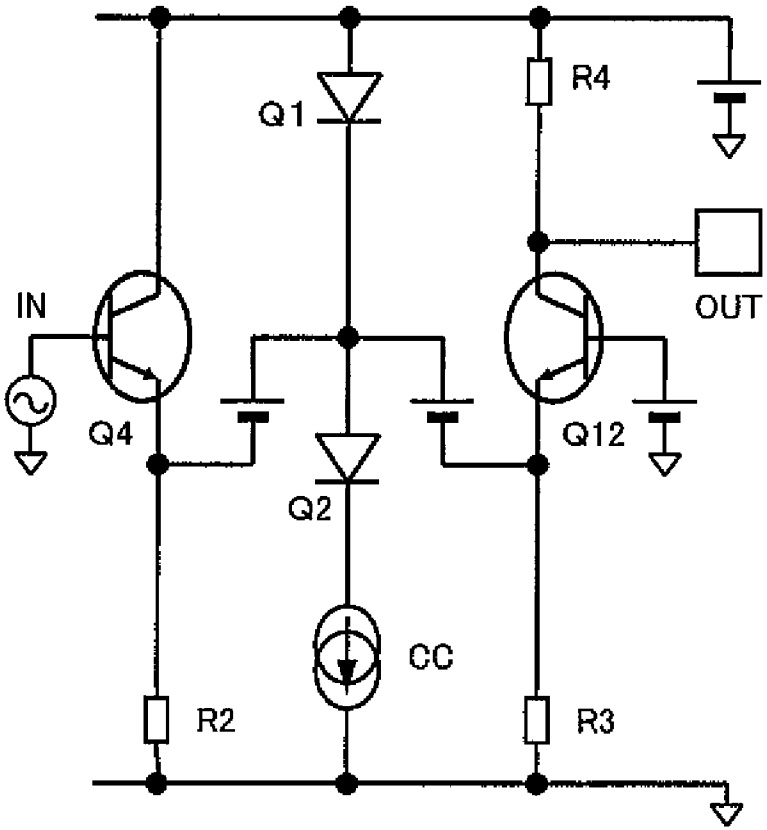
FIG. 7 depicts a still further simplified form of the circuit shown in FIG. 6.

For example, when the CB capacitances of the transistors at the high frequencies in the circuit shown in FIG. 1 are replaced with a power supply for retaining a voltage, the circuit of FIG. 1 can be simplified as illustrated in FIG. 5. Further, when the circuit of FIG. 5 is developed by removing the transistors Q3, Q5, Q6, Q9, Q10, and Q11, a circuit as shown in FIG. 6 is obtained. Still further, when the transistors Q1 and Q2 are represented simply by diodes and the transistors Q7 and Q8 are represented only by direct current power supplies in the circuit of FIG. 6, the circuit can be also depicted as shown in FIG. 7.

Figure 9:
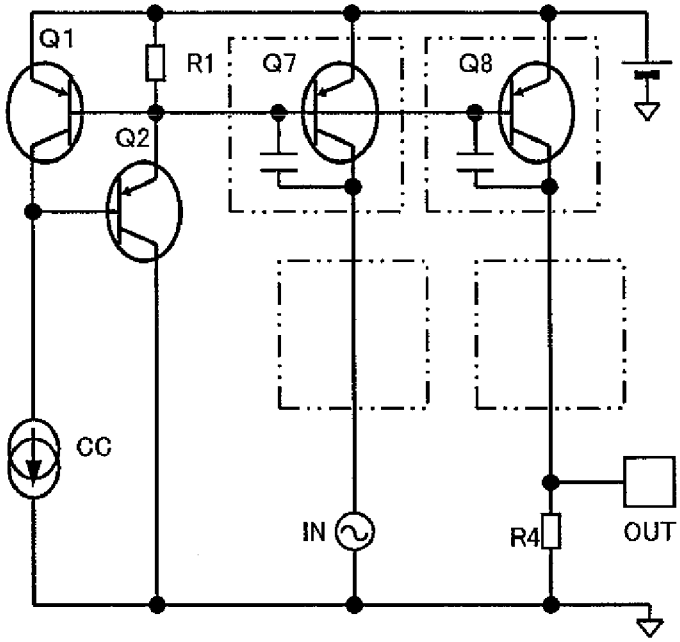
FIG. 9 depicts a further modified configuration of the circuit shown in FIG. 6.

Finally, the most simplified diagram of the above-described circuit is shown in FIG. 9. In the circuit of FIG. 9, the direct current power supplies are omitted, and the CB capacitances of the transistors Q7 and Q8 are described as capacitances in their original forms.

As can be seen from FIG. 9, it is found that, in the current mirror circuit having a plurality of outputs, signal leakage to the base line of the current mirror transistor due to the CB capacitance of one transistor (for example, the transistor Q7) causes the collector of the output transistor Q12 (not illustrated in FIG. 9) to undergo a DC change which allows the signal to be leaked to the output.

Figure 8:
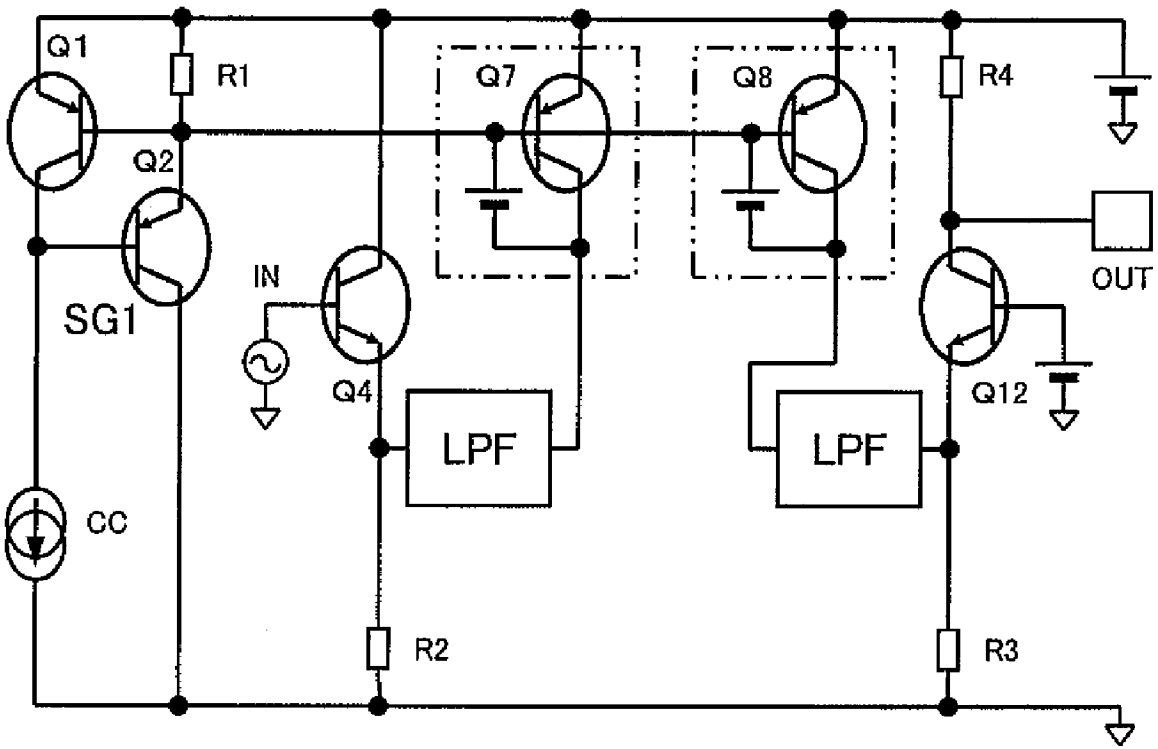
FIG. 8 depicts another configuration of the circuit shown in FIG. 6 in which a low-pass filter is added.
Figure 10:
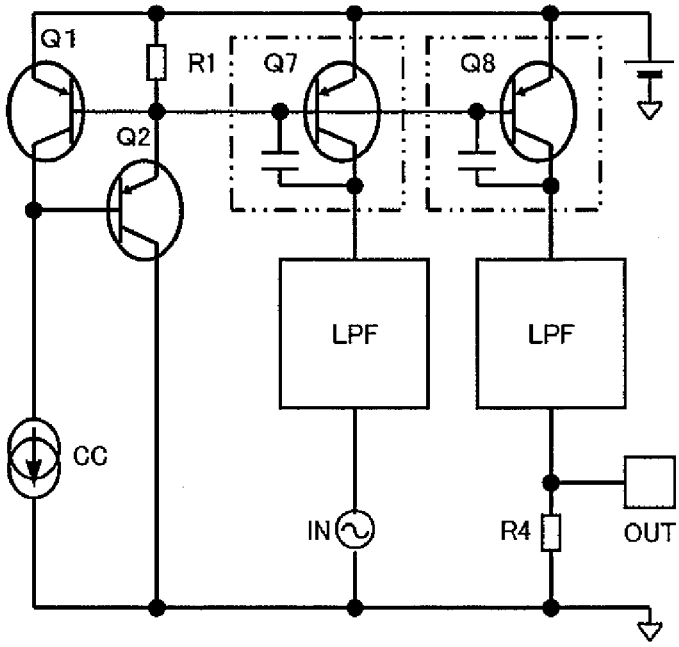
FIG. 10 depicts a configuration in which a low-pass filter is added to the circuit shown in FIG. 9.

With this in view in the present embodiment, a low pass filter is mounted between an output collector and a part that receives a current from the output collector, to thereby eliminate the DC change which results in the signal leakage. More specifically, in this embodiment, a low pass filter LPF is inserted, as illustrated in FIG. 10, between an input signal source and the collector of the transistor Q7 and between the collector of the transistor Q8 and the output terminal OUT for outputting the signal, to remove, in the low pass filter LPF, the high-frequency component from the signal with a view toward preventing the signal leakage being transferred over the base line of the current mirror circuit. A slightly more detailed illustration of the circuit of FIG. 10 is shown in FIG. 8.

Here, the low pass filter LPF is preferably configured in a form as depicted in FIG. 11A, 11B, 11C, or 11D.

Figure 11A:
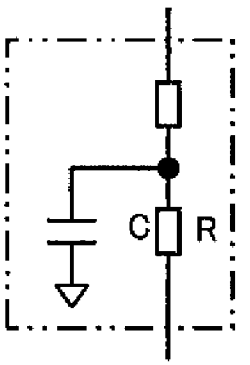
FIG. 11A shows a structure of the low-pass filter.
Figure 11B:
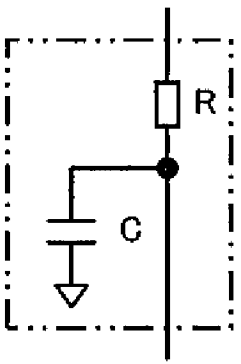
FIG. 11B shows another structure of the low-pass filter.
Figure 11C:
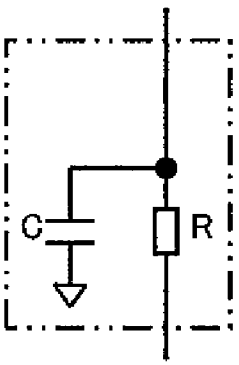
FIG. 11C shows still another structure of the low-pass filter.

In FIG. 11A, a connection point between two resistances connected in series is connected to one end of a capacitance whose the other end is connected to ground. In FIG. 11B, a lower side (a ground side) of one resistance is connected to one end of the capacitance whose other end is connected to ground. In FIG. 11C, an upper side (a positive power supply side) of one resistance is connected to one end of the capacitance whose other end is connected to ground.

Figure 11D:
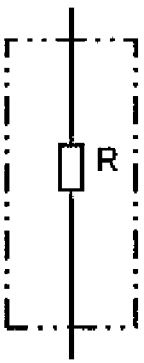
FIG. 11D shows a further structure of the low-pass filter.
Figure 12:
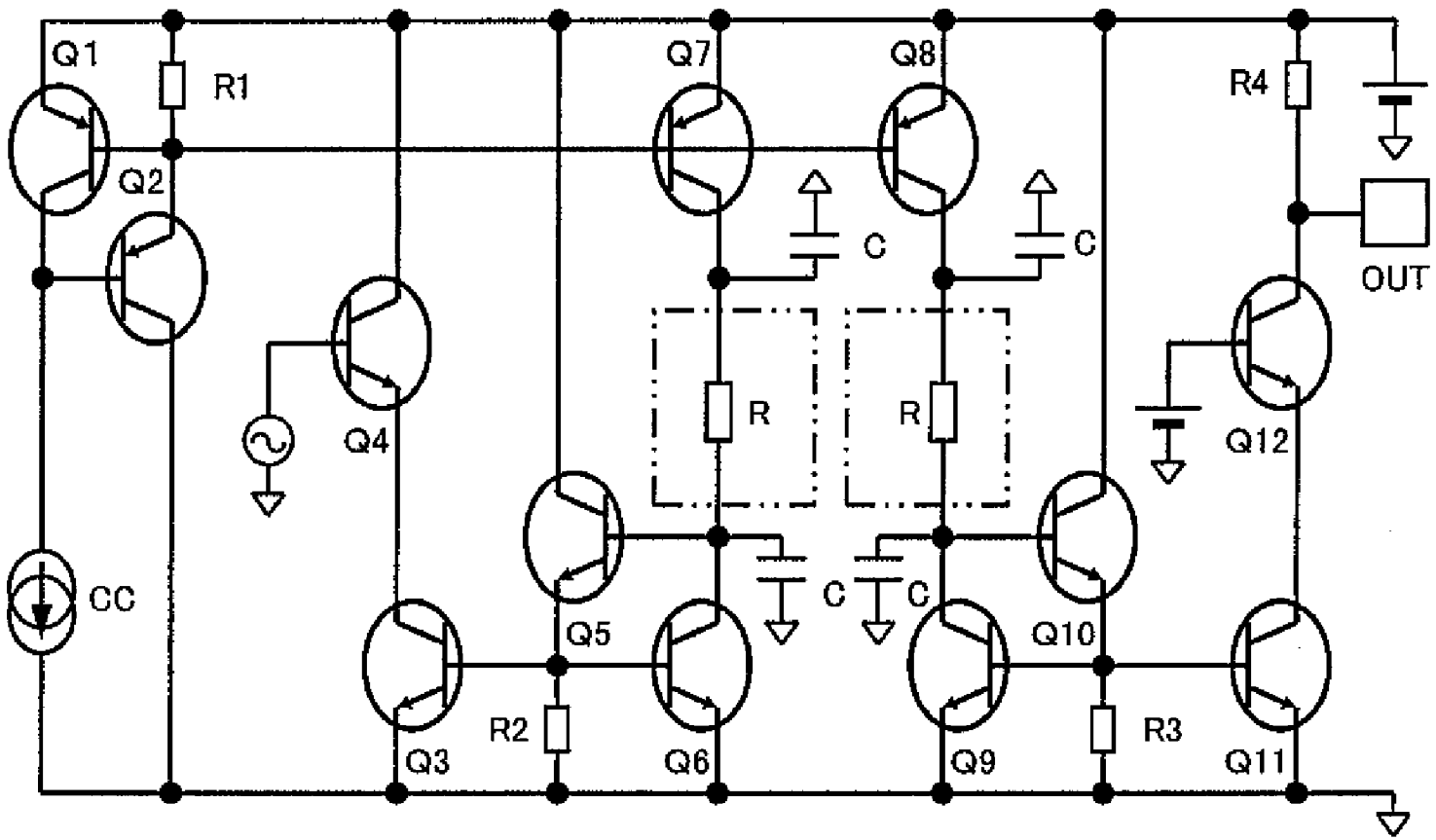
FIG. 12 shows a configuration according to the embodiment using a parasitic capacitance.

On the other hand, in FIG. 11D, only the resistance is disposed on wiring. In this form of wiring with only the resistance, because each of the transistors in a semiconductor integrated circuit has a parasitic capacitance between a collector and a substrate (a C-SUB capacitance), the low pass filter LPF may be configured by only the resistance as shown in FIG. 12. More specifically, in the semiconductor integrated circuit, various types of transistors are formed by implanting impurities into a silicon substrate to thereby form an N well, a P well, an N region, a P region, and others. Accordingly, the parasitic capacitance is generated between a collector (C) region and the substrate (SUB). Then, this parasitic capacitance can be used as a capacitance for the low pass filter LPF. Such usage of the capacitance allows the high-frequency component to escape to a substrate side. For example, because the parasitic capacitance exists on each collector side of the transistors as shown in FIGS. 11A to 11D, the low pass filter LPF can be formed on a wiring line by disposing the resistance on the wiring line for connecting the collectors of the transistor Q7 and of the transistor Q6, or by disposing the resistance on a wiring line for connecting the collectors of the transistor Q8 and of the transistor Q10.

FIGS. 13A, 14A, 15A, and 16A show circuits according to other embodiments. It should be noted that a signal output corresponding to an input to the transistor Q4 is not illustrated in FIGS. 13A, 14A, 15A, and 16A. In each of the circuits, the low pass filter LPF using the series resistances and the capacitance in combination as shown in FIG. 11A is mounted on both the wiring line for connecting the collectors of the transistor Q7 and of the transistor Q6, and the wiring line for connecting the collectors of the transistor Q8 and of the transistor Q10.

On the other hand, FIGS. 13B, 14B, 15B, and 16B are diagrams each showing an effect obtained by the provision of the low pass filter LPF as described above. In FIGS. 13B, 14B, 15B, and 16B, a curve designated as "NEW CIRCUIT" represents the circuit according to the embodiment. It can be seen from the drawings that signal leakage is suppressed in a wide range of from several megahertzs (MHz) to 1 gigahertz (GHz).

Figure 13B:
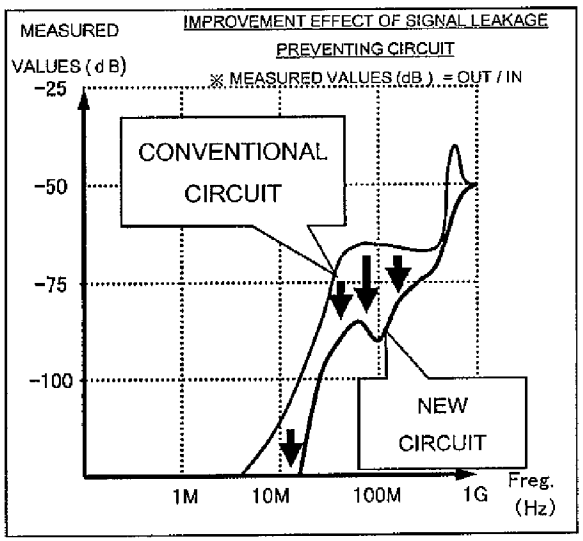
FIG. 13B is a diagram showing an improvement effect of adding the low-pass filter to the circuit shown in FIG. 1.
Figure 13A:
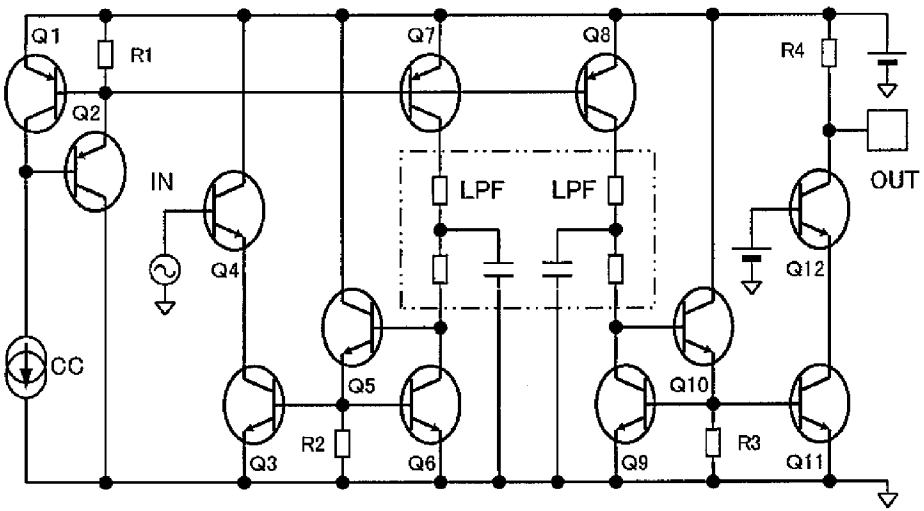
FIG. 13A is a diagram showing a configuration according to an embodiment in which the low-pass filter is added to the circuit shown in FIG. 1.
Figure 14B:
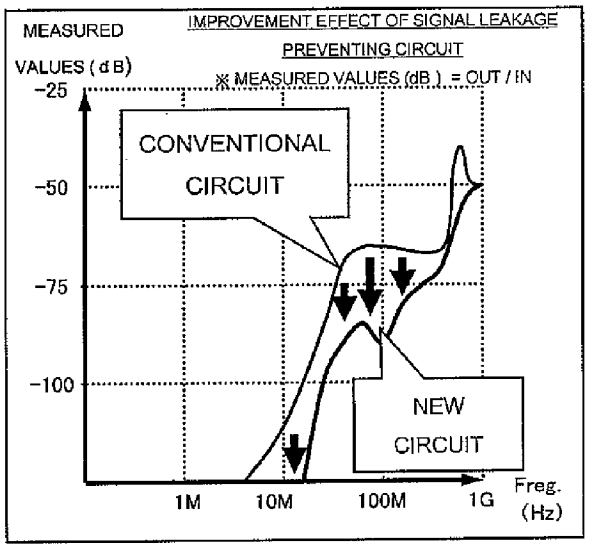
FIG. 14B is a diagram showing an improvement effect of adding the low-pass filter to the circuit shown in FIG. 2.
Figure 14A:
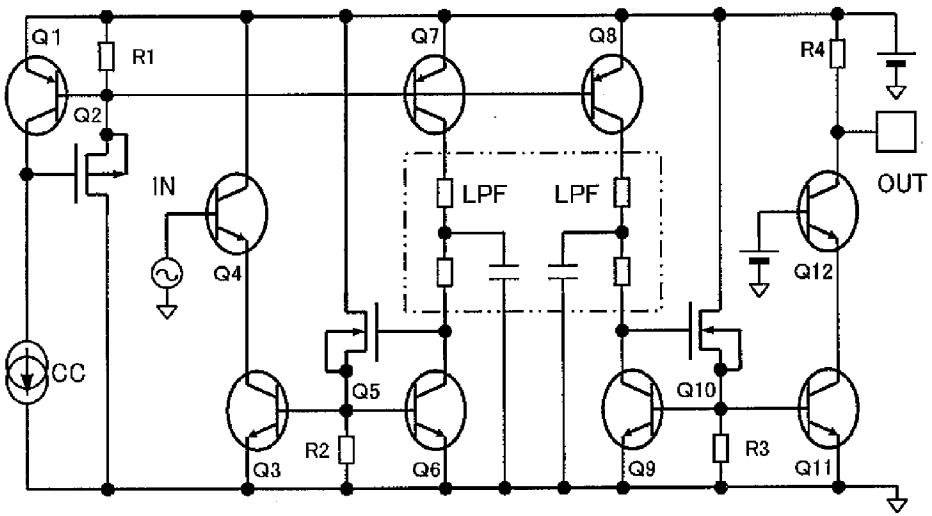
FIG. 14A is a diagram showing a configuration according to an embodiment in which the low-pass filter is added to the circuit shown in FIG. 2.
Figure 15B:
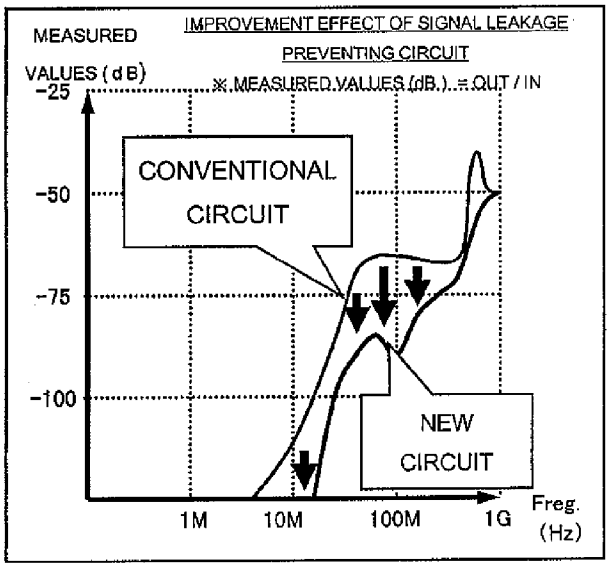
FIG. 15B is a diagram showing an improvement effect of adding the low-pass filter to the circuit shown in FIG. 3.
Figure 15A:
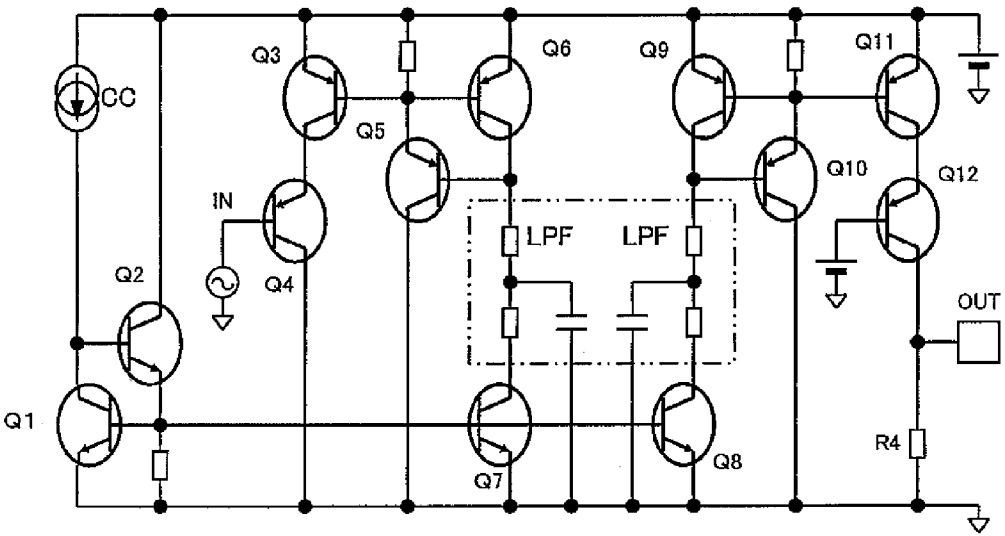
FIG. 15A is a diagram showing a configuration according to an embodiment in which the low-pass filter is added to the circuit shown in FIG. 3.
Figure 16B:
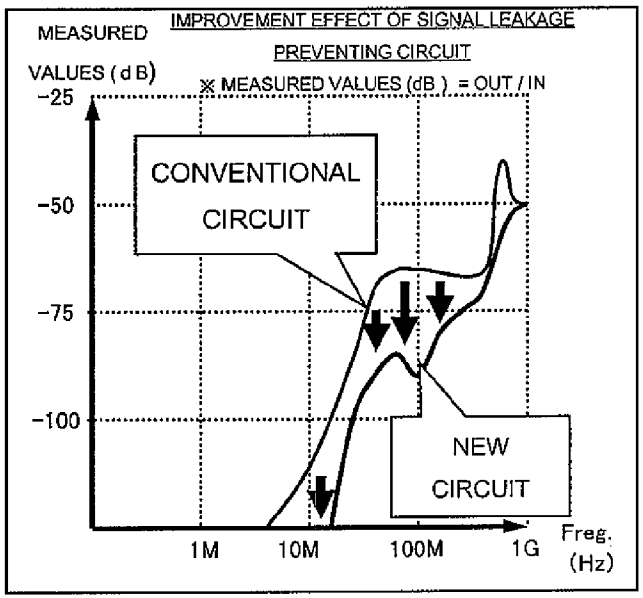
FIG. 16B is a diagram showing an improvement effect of adding the low-pass filter to the circuit shown in FIG. 4.
Figure 16A:
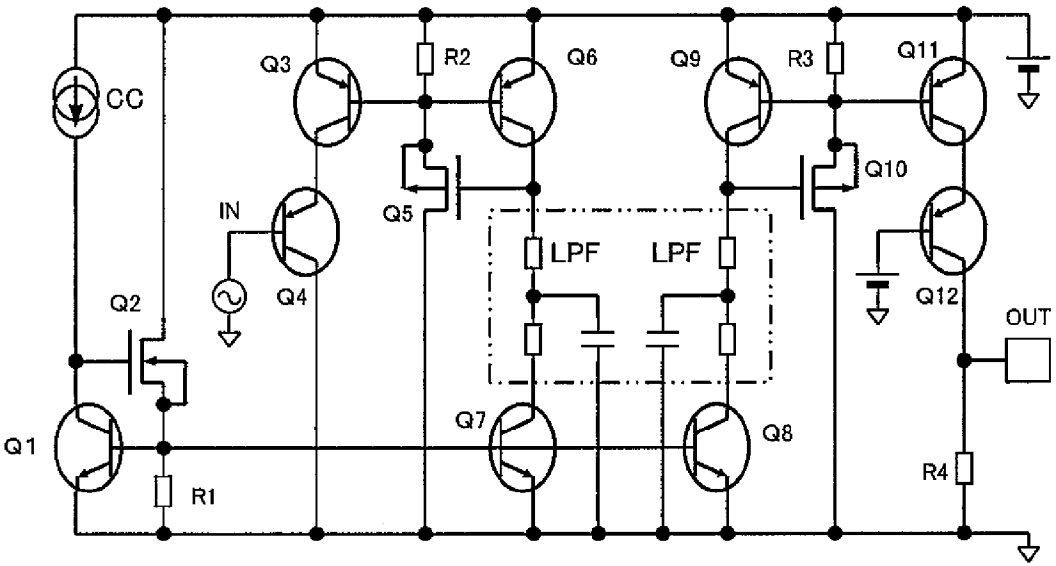
FIG. 16A is a diagram showing a configuration according to an embodiment in which the low-pass filter is added to the circuit shown in FIG. 4.
Figure 17:
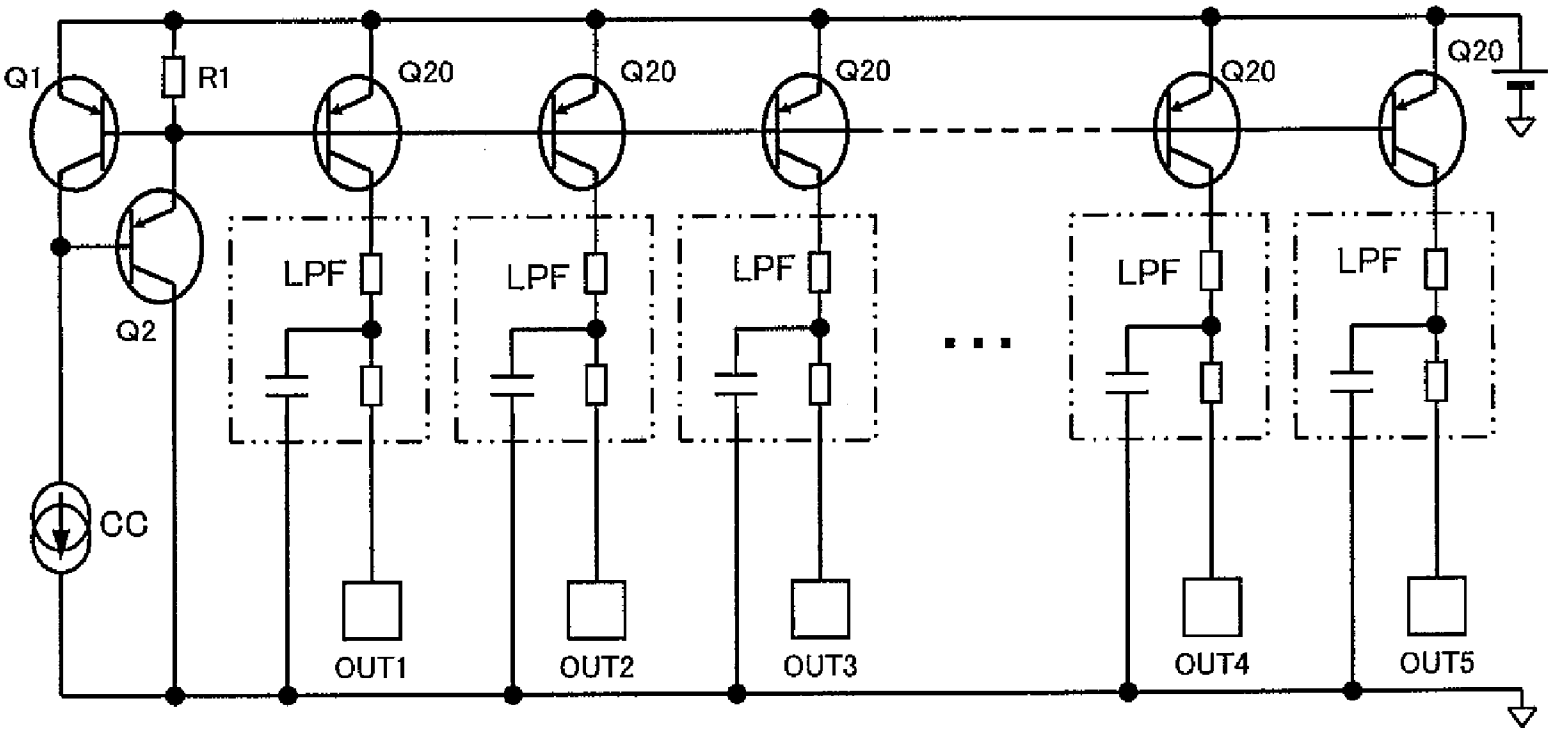
FIG. 17 is a diagram in which a plurality of output terminals are installed in a current mirror circuit having the configuration shown in FIG. 1, and a low-pass filter is provided for each of the output terminals.
Figure 18:
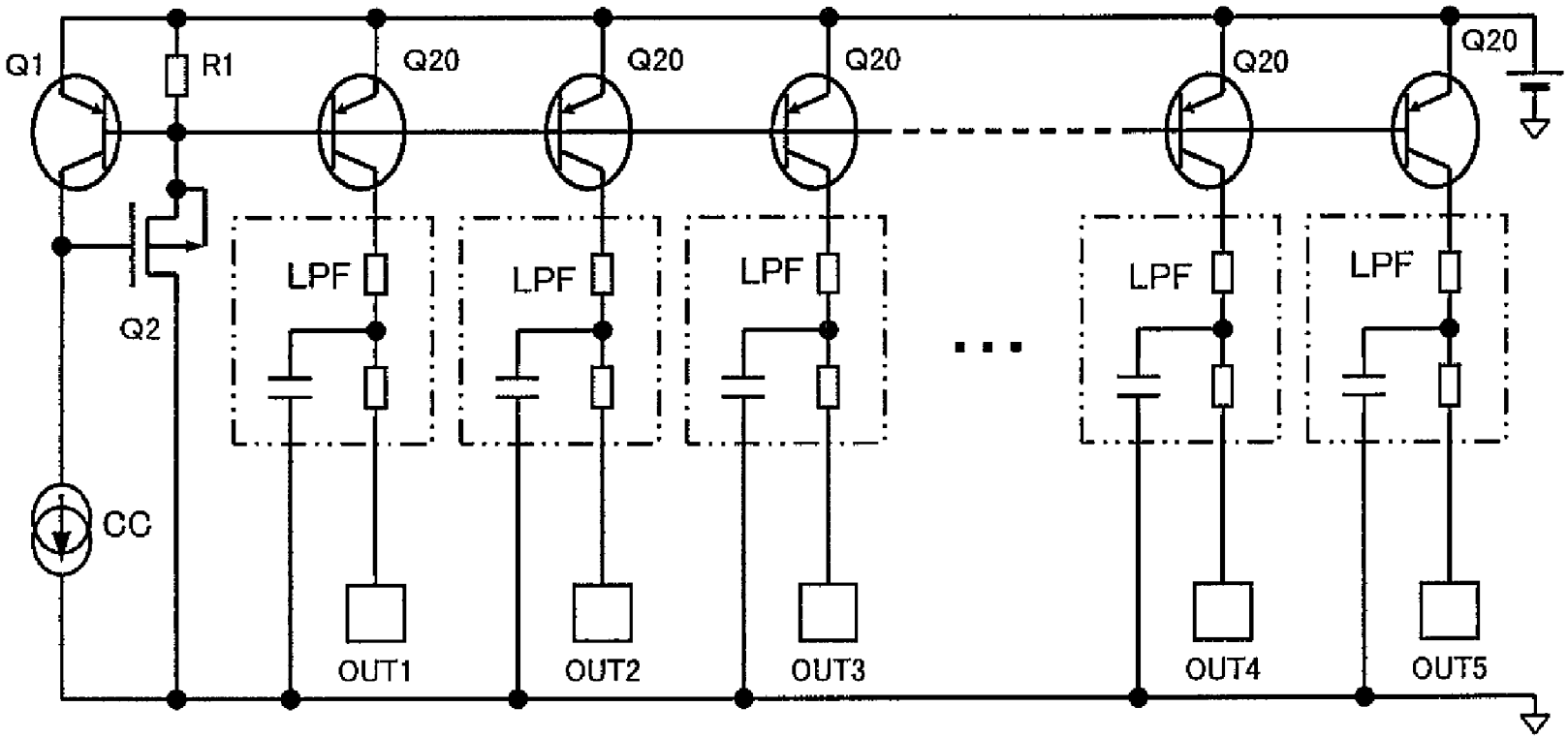
FIG. 18 is a diagram in which a plurality of output terminals are installed in a current mirror circuit having the configuration shown in FIG. 2, and a low-pass filter is provided for each of the output terminals.
Figure 19:
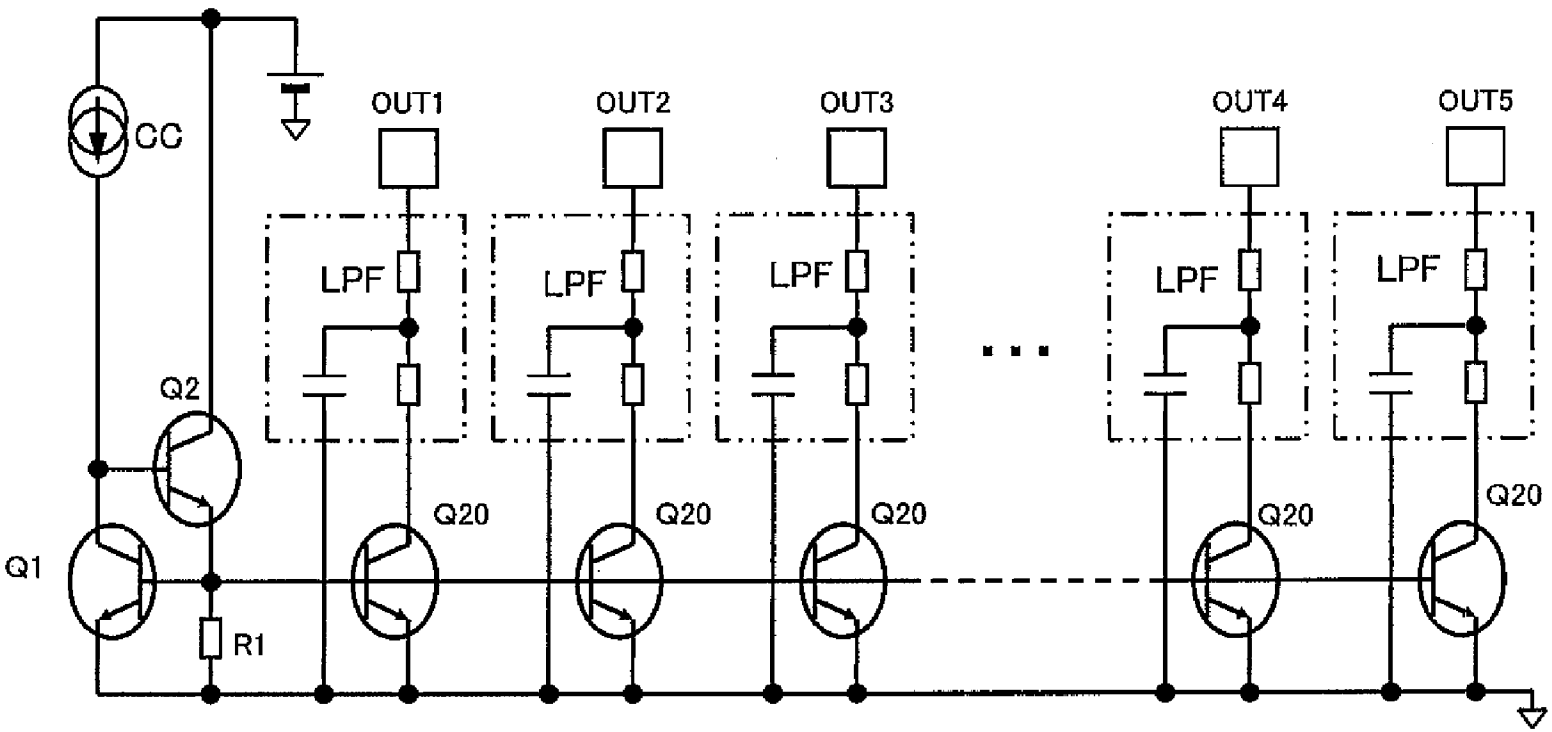
FIG. 19 is a diagram in which a plurality of output terminals are installed in a current mirror circuit having the configuration shown in FIG. 3, and a low-pass filter is provided for each of the output terminals.
Figure 20:
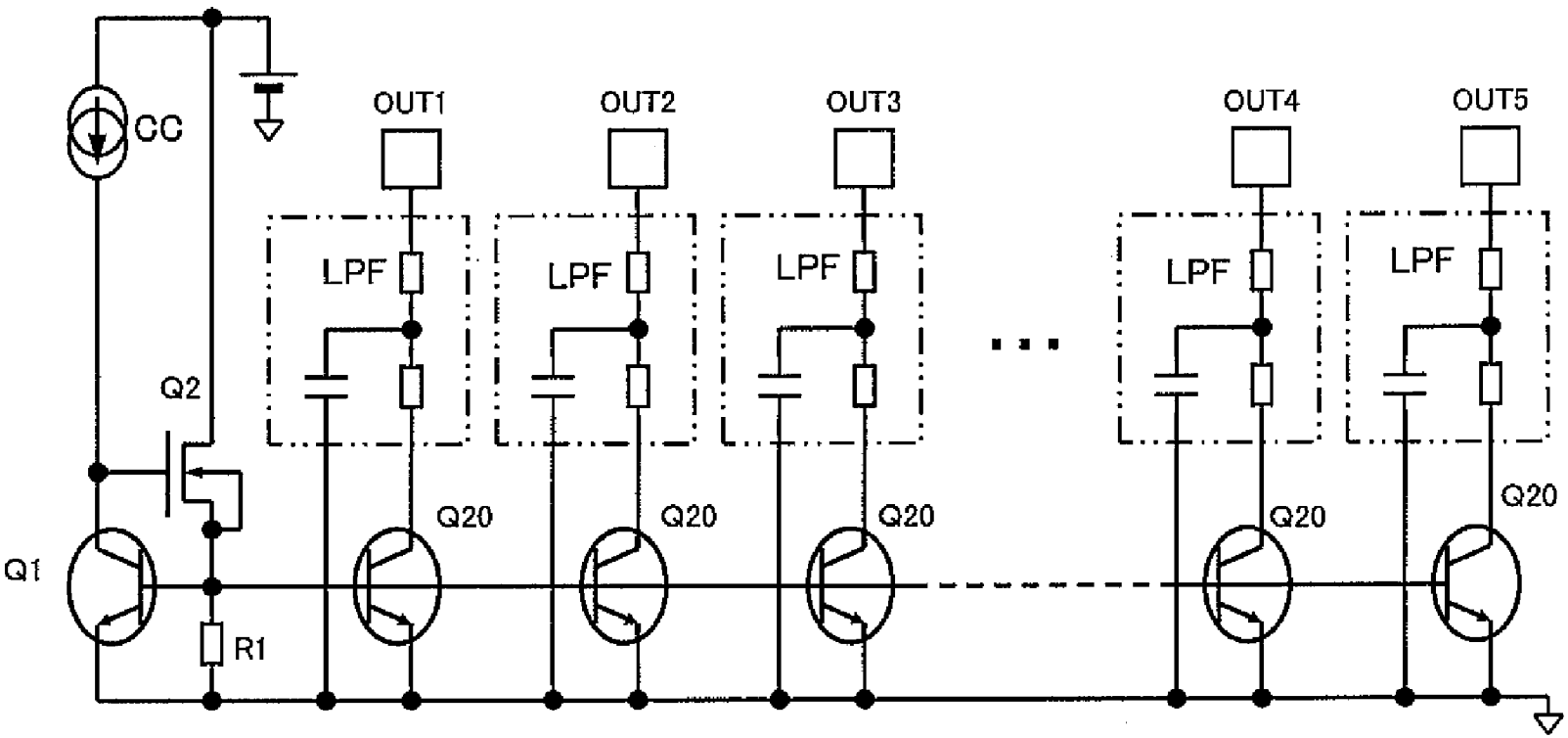
FIG. 20 is a diagram in which a plurality of output terminals are installed in a current mirror circuit having the configuration shown in FIG. 4, and a low-pass filter is provided for each of the output terminals.

Specifically, FIG. 13A shows the circuit configured by adding the low pass filters LPFs into the circuit shown in FIG. 1, FIG. 14A shows the circuit configured by adding the low pass filters LPFs into the circuit shown in FIG. 2, FIG. 15A shows the circuit configured by adding the low pass filters LPFs into the circuit shown in FIG. 3, and FIG. 16A shows the circuit configured by adding the low pass filters LPFs into the circuit shown in FIG. 4.

FIGS. 17, 18, 19, and 20 show application examples of the present embodiment. In the application examples, the base line of one current mirror input transistor Q1 is connected to multiple current mirror output transistors Q20s from which the constant currents are respectively output, and the output constant currents are supplied to respective output terminals. In addition, the low pass filter LPF is disposed on each current path between the current mirror output transistors Q20s and the output terminals, to remove the high-frequency component through the low pass filter LPF on the current path. The current mirror circuit including the low pass filters is integrated into one cell, and the outputs from the current mirror output transistors Q20s is connected to output terminals of the cell to respectively supply the constant current via the output terminals of the cell to operation circuits installed outside the cell.

As described above, the current mirror circuit having a plurality of the constant current outputs is integrated into one cell, and the low pass filter is mounted on a part from which the constant currents are output, to thereby remove the high-frequency component. In this manner, a high-frequency signal being transferred from one output terminal via the base line of the current mirror circuit to another output terminal can be prevented.

Therefore, without taking into account the effect of high frequencies transferred via the base line of the current mirror circuit to each of the output terminals (OUT 1, 2, 3, . . . 4, and 5) from which the constant current is output, a circuit to be connected to each of the output terminals can be designed.

It should be noted that all the transistors may be configured using the MOS transistors, which has not explained in the description above. In this case, the PNP type corresponds to a P channel, the NPN type corresponds to an N channel, the collector corresponds to a drain, the emitter corresponds to a source, and the base (the control end) corresponds to the gate (the control end).

What is claimed is:

1. A constant current circuit for supplying a constant current to each of a plurality of operating circuits, comprising:

a current mirror input transistor through which an input-side constant current flows; and a plurality of current mirror output transistors that each have a control end that is commonly connected to a control end of the current mirror input transistor, and each of the plurality of current mirror output transistors supply an output-side constant current to a corresponding one of the plurality of operating circuits, wherein the output-side constant current corresponds in magnitude to the input-side constant current, wherein at least one of the plurality of current mirror output transistors is equipped with a low pass filter for removing a high-frequency component contained in the respective output-side constant current, wherein the low pass filter comprises two resistors and a capacitor, wherein the two resistors are connected in series at a common node, one of the two resistors connected in series is connected to a collector node of at least one of the plurality of current mirror output transistors, one end of the capacitor is connected to the common node, and one end of the capacitor is connected to a ground node, and wherein the low pass filter removes the high-frequency component in the output-side current.

2. The constant current circuit according to claim 1, wherein the low pass filter for removing the high-frequency component is connected to an output side of the current mirror output transistors.

3. The constant current circuit according to claim 2, wherein the low pass filter for removing the high-frequency component is connected to the output side of each of the plurality of current mirror output transistors.

4. The constant current circuit according to claim 1, wherein the low pass filter is configured using a resistance and a parasitic capacitance which is parasitic on both the resistance and a line connected to the resistance.

5. The constant current circuit according to claim 1, wherein the constant current circuit is integrated into one cell, and output currents from the plurality of current mirror output transistors are respectively output from a plurality of output terminals of the one cell.

* * * * *